US005159158A

United States Patent [19]

Sakich et al.

[11] Patent Number: 5,159,158

[45] Date of Patent: Oct. 27, 1992

[54] ELECTRICAL ASSEMBLY WITH INSULATING COLLAR FOR COUPLING SECTIONS OF WEATHERSHED HOUSINGS

[75] Inventors: John D. Sakich, Wadsworth; Waymon P. Goch, Clinton, both of Ohio

[73] Assignee: Hubbell Incorporated, Orange, Conn.

[21] Appl. No.: 609,753

[22] Filed: Nov. 7, 1990

[51] Int. Cl.[5] ..... H01B 17/12

[52] U.S. Cl. ..... 174/179; 174/140 S; 174/141 R; 174/209

[58] Field of Search ..... 174/80, 111, 140 S, 174/141 R, 150, 178, 179, 186, 209; 338/21; 361/126, 127, 128; 138/120, 155; 285/112, 235, 258, 381; 403/286, 335, 338, 341

[56] References Cited

U.S. PATENT DOCUMENTS

| | | | |
|---|---|---|---|
| 2,135,085 | 11/1938 | Ludwig et al. | 361/128 |
| 2,586,285 | 2/1952 | Ackermann | 361/128 |
| 2,593,955 | 4/1952 | Ackermann | 361/124 |
| 3,139,468 | 6/1964 | Wheat | 285/381 X |
| 3,328,631 | 6/1967 | Greber | 361/127 X |
| 3,793,475 | 2/1974 | Yonkers | 174/73.1 |
| 3,898,372 | 8/1975 | Kalb | 174/179 |
| 4,207,364 | 6/1980 | Nyberg | 174/73.1 X |
| 4,212,696 | 7/1980 | Lusk et al. | 174/179 X |
| 4,373,113 | 2/1983 | Winkler et al. | 174/179 |
| 4,390,745 | 6/1983 | Bottcher et al. | 174/73.1 |
| 4,427,843 | 1/1984 | Ishihara et al. | 174/140 S |

FOREIGN PATENT DOCUMENTS

| | | | |
|---|---|---|---|
| 0280189 | 8/1988 | European Pat. Off. | 338/21 |
| 72553 | 4/1970 | Fed. Rep. of Germany | 174/150 |
| 123809 | 1/1959 | U.S.S.R. | 285/381 |

*Primary Examiner*—Leo P. Picard
*Assistant Examiner*—Trinidad Korka
*Attorney, Agent, or Firm*—Jerry M. Presson; Alfred E. Goodman

[57] ABSTRACT

An electrical assembly, such as an insulator or a surge arrester, utilizing a plurality of elastomeric weathershed housings for enclosing a core member therein. The elastomeric weathershed housings are coupled and sealed together by an insulating collar. A radially directed force is applied to the collar or the weathershed housings to cause intimate contact between the collar and the end portions of the weathershed housings to provide a weathertight seal. In the preferred embodiment, the radially directed force is provided by insertion of the core member into the axial bore of the weathershed housings causing radial outward expansion of the weathershed housings into intimate contact with the insulating collar. In another embodiment, the radially directed force is provided by a heat shrinkable insulating collar, which is shrunk about the end portions of adjacent weathershed housings. The core member can be an insulating rod or a plurality of electrical components, such as metal oxide varistors.

22 Claims, 3 Drawing Sheets

ELECTRICAL ASSEMBLY WITH INSULATING COLLAR FOR COUPLING SECTIONS OF WEATHERSHED HOUSINGS

FIELD OF THE INVENTION

This invention relates to an electrical assembly, such as an insulator or a surge arrester, having an insulating collar for coupling adjacent ends of elastomeric weathershed housings together. More specifically, the invention relates to coupling and sealing adjacent ends of elastomeric weathershed housings by applying a radially directed force on either the weathershed housings or the insulating collar to ensure intimate contact between the weathershed housings and the insulating collar.

BACKGROUND OF THE INVENTION

Electrical assemblies, such as insulators and surge arresters, are typically enclosed within a weathershed housing for insulating and protecting the internal electrical components or core members from the outside environment. Insulators are extensively used to support the electrical conductors of electric power lines. Surge arresters, on the other hand, are commonly connected across electrical equipment to shunt over-voltage surges, such as lightning strikes. As the voltage of power lines increases, the length of the insulator or surge arrester must also be increased. Accordingly, insulators and surge arresters vary in length depending upon their application. In fact, insulators and arresters can be very long.

Several methods and devices have been developed for manufacturing and connecting sections of weathershed housings to accommodate various lengths of insulators and surge arresters. However, these prior methods and devices have several disadvantages. For example, one piece weathershed housings require custom molding to obtain the particular length needed. Moreover, if there is a defect in the one piece weathershed housing, then the entire length of the weathershed housing must be discarded. Also, one piece weathershed housings are very expensive and time consuming to manufacture. Accordingly, electrical assemblies have been developed which utilize a plurality of sections of weathershed housings, instead of one piece. These prior electrical assemblies are typically either difficult to interconnect or do not provide a sufficient seal between adjacent sections of weathershed housings.

Examples of these prior electrical assemblies are disclosed in the following U.S. Pat. No. 2,135,085 to Ludwig et al; U.S. Pat. No. 2,586,285 to Ackermann; U.S. Pat. No. 2,593,955 to Ackermann; U.S. Pat. No. 3,328,631 to Greber; U.S. Pat. No. 3,793,475 to Yonkers; U.S. Pat. No. 3,898,372 to Kalb; U.S. Pat. No. 4,212,696 to Lusk et al; U.S. Pat. No. 4,373,113 to Winkler et al; and U.S. Pat. No. 4,427,843 to Ishihara et al.

In view of the above, it is apparent that there exists a need to provide electrical assemblies with a weathershed housing made of a plurality of sections that are coupled and sealed together in a weathertight manner. This invention addresses this need in the art along with other needs which will become apparent to those skilled in the art once given this disclosure.

SUMMARY OF THE INVENTION

Accordingly, a primary object of the invention is to provide an electrical assembly which utilizes a plurality of elastomeric weathershed housings coupled together by an insulating collar for providing a greatly improved weathertight seal between adjacent ends of the weathershed housings.

Another object of the invention is to provide an electrical assembly utilizing a plurality of elastomeric weathershed housings which is relatively inexpensive and simple to manufacture and assemble.

A further object of the invention is to provide an electrical assembly utilizing a plurality of elastomeric weathershed housings which is forgiving of dimensional variations in its associated parts, thereby reducing the need for expensive close tolerances to provide an effective seal.

The foregoing objects are basically attained by an electrical assembly, the combination comprising: a core member having an outer surface with a predetermined cross-sectional width; first and second weathershed housings formed of an elastomeric material, each of the weathershed housings having a first end, a second end, and an axially extending bore with a predetermined cross-sectional width for slideably receiving the core member therein; the second end of the first weathershed housing having a portion with a predetermined outer diameter, and the first end of the second weathershed housing having a portion with a predetermined outer diameter; and a coupling assembly for coupling and sealing the first and second weathershed housings together, the coupling assembly including an insulating collar having an axially extending bore with an inner diameter for receiving the portions of the first and second weathershed housings, the inner diameter of the insulating collar and the outer diameters of the portions of the first and second weathershed housings being sized to intimately contact one another upon applying a radially directed force causing relative radial movement of the insulating collar and the portions of the first and second weathershed housings.

Other objects, advantages and salient features of the invention will become apparent from the following detailed description, which, taken in conjunction with the annexed drawings, discloses several preferred embodiments of the invention.

BRIEF DESCRIPTION OF THE DRAWINGS

Referring to the drawings which form a part of this original disclosure.

DETAILED DESCRIPTION OF THE INVENTION

Figure 1:
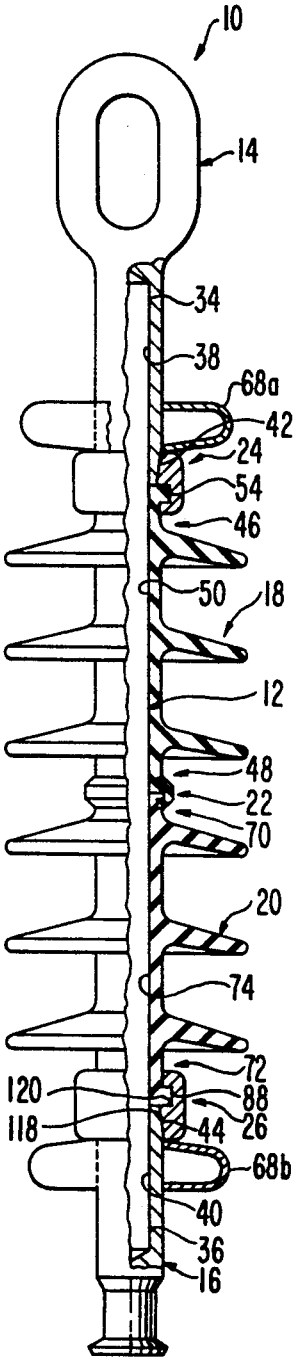
FIG. 1 is a side elevational view in partial section of an electrical assembly in the form of an electrical insulator in accordance with one embodiment of the present invention.

Initially referring to FIG. 1, an electrical assembly 10 according to the present invention is illustrated in the form of an insulator. Electrical assembly 10 includes an insulating core member 12, a first end fitting or connector 14 coupled to the upper end of core member 12, a second end fitting 16 coupled to the lower end of core member 12, a first elastomeric weathershed housing 18 overlying and enclosing a first portion of core member 12, a second elastomeric weathershed housing 20 overlying and enclosing a second portion of core member 12, an insulating collar 22 for coupling and sealing adjacent ends of first and second weathershed housings 18 and 20 together, a first metallic end collar 24 for coupling and sealing the upper end of weathershed housing 18 to end fitting 14, and a second metallic end collar 26 for coupling the lower end of weathershed housing 20 to end fitting 16.

While only two weathershed housings 18 and 20 are illustrated, it should be apparent that more than two elastomeric weathershed housings can be utilized to cover core member 12 with adjacent ends of the weathershed housings being coupled together by an insulating collar 22, which is discussed in more detail below.

Core member 12 is illustrated as an elongated cylindrical insulating rod, which is preferably composed of fiberglass reinforced epoxy, vinylester or polyester resin. Core member 12 also can be formed from other electrical components, such as varistors, resistors, capacitors, or any combination thereof. Core member 12, as seen in FIG. 1, has a substantially uniform outer diameter with its upper and lower ends 34 and 36 fixedly coupled to end fittings 14 and 16 in a conventional manner, such as crimping.

End fittings 14 and 16 are conventional metallic end fittings, and thus will not be discussed in detail. End fittings 14 and 16 have axially extending bores 38 and 40, respectively, for receiving upper and lower ends 34 and 36 of core member 12 therein to fixedly couple them together by crimping. Each of the end fittings 14 and 16 has a tapered portion 42 and 44, respectively, for fixedly coupling end collars 24 and 26 thereto by a press fit as discussed in more detail below.

Weathershed housing 18 has a first or upper end portion 46 and a second or lower end portion 48 with an axially extending bore 50 extending between upper end portion 46 and lower end portion 48. Bore 50 preferably has a substantially uniform cylindrical inner surface 52 with an internal diameter, or cross-sectional width, which is smaller than or equal to the diameter, or cross-sectional width, of core member 12 when in its unstressed state. Bore 50 or core member 12 can be coated with a viscous insulating material, such as silicone grease, to prevent the ingress of contaminants along the interface of core member 12 and bore 50 of weathershed housing 18. Alternatively, bore 50 can have a series of annular grooves filled with a viscous insulating material as disclosed in U.S. Pat. No. 3,898,372 to Kalb, which is hereby incorporated herein by reference. Weathershed housing 18 is composed of a polymeric, elastomeric material having sufficient resiliency to be expanded radially outwardly upon insertion of core member 12 into axially extending bore 50.

Figure 5:
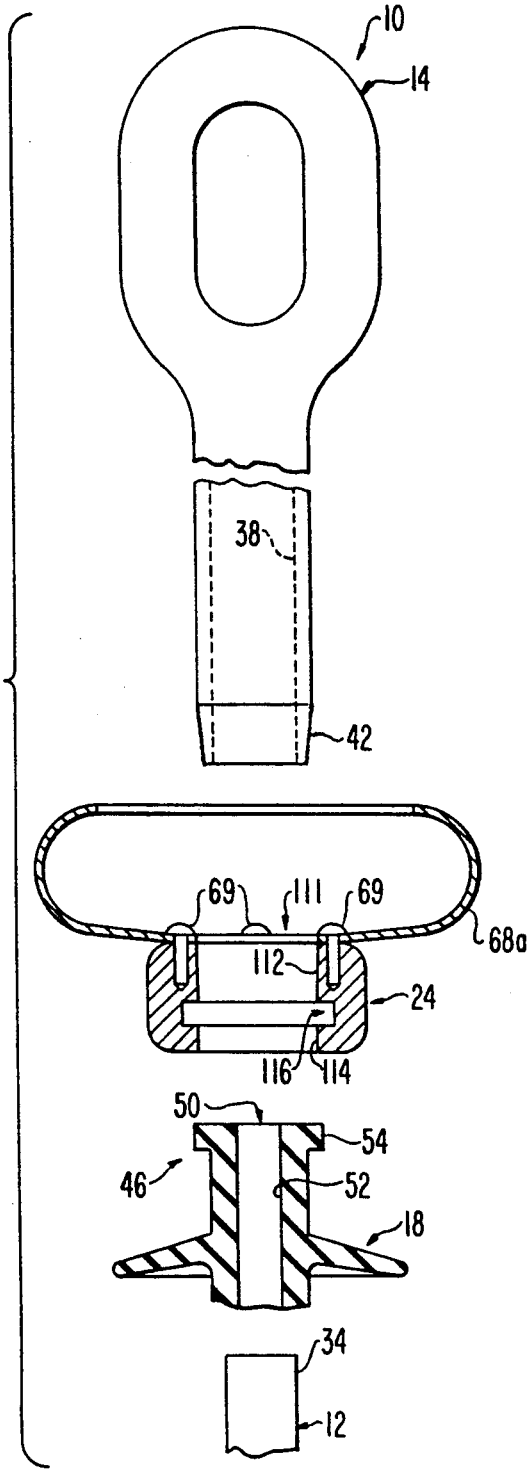
FIG. 5 is an enlarged, exploded, side elevational view in partial section of the upper end of the electrical assembly illustrated in FIGS. 1–4 with a corona shield coupled to the upper end of the collar.

As seen in FIGS. 1 and 5, upper end portion 46 of first weathershed 18 has an outwardly extending annular end flange 54, which is coupled to end collar 24 for sealing the space between weathershed housing 18 and end fitting 14 as discussed below in more detail. Alternatively, annular end flange 54 can be formed by an outwardly opening annular recess. In other words, end flange 54 of upper end portion 46 can be substantially identical to annular flange 58 of lower end portion 48 as seen in FIG. 2.

Figure 2:
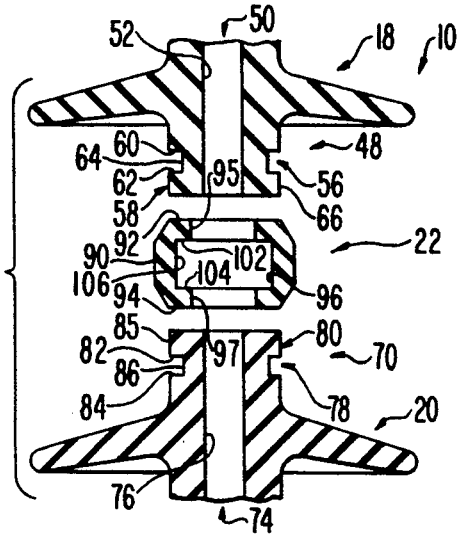
FIG. 2 is an enlarged, partial side elevational view in longitudinal cross section of the electrical assembly illustrated in FIG. 1, prior to coupling of the weathershed housings together and prior to insertion of a core member therein.

As seen in FIG. 2, lower end portion 48 of weathershed housing 18 has an annular recess 56 which opens outwardly and forms an annular flange 58. Annular recess 56 is defined by a pair of opposed annular planar walls 60 and 62 and a cylindrical surface 64 interconnecting opposed walls 60 and 62. The maximum outer diameter of lower end portion 48 is defined by the outer cylindrical surface 66 of annular flange 58.

As seen in FIGS. 1–4 weathershed housing 20 has a first or upper end portion 70 and a second or lower end portion 72 with an axially extending bore 74 extending between upper end portion 70 and lower end portion 72. Preferably, bore 74 has a substantially uniform cylindrical inner surface 76 with an internal diameter or cross-sectional width which is smaller than the outer diameter of core member 12, when in its unstressed state. Bore 74 or core member 12 can be coated with a viscous insulating material, such as silicone grease, to prevent the ingress of contaminants along the interface of core member 12 and bore 74 of weathershed housing 20. Alternatively, bore 74 can have a series of axially spaced, annular grooves filled with a viscous insulating material as disclosed in U.S. Pat. No. 3,898,372 to Kalb. Weathershed housing 20 is composed of a polymeric, elastomeric material having sufficient resiliency to expand radially outwardly upon insertion of core member 12 into bore 74.

Upper end portion 70 of weathershed housing 20 has an annular recess 78 which forms an annular flange 80. Annular recess 78 is defined by a pair of opposed annular planar walls 82 and 84 and a cylindrical surface 86 interconnecting opposed walls 82 and 84. The maximum outer diameter of upper end portion 70 is defined by the outer cylindrical surface 85 of annular flange 80.

As seen in FIG. 1, second or lower end portion 72 of weathershed housing 20 has an outwardly extending annular end flange 88, which is coupled to end collar 26 for sealing the space between weathershed housing 20 and end fitting 16, as discussed below in more detail. Alternatively, annular end flange 88 can be formed by an outwardly opening annular recess. In other words, lower end portion 72 with annular end flange 88 can be substantially identical to upper end portion 70 with annular flange 80 as seen in FIG. 2.

As particularly seen in FIG. 2, insulating collar 22 has a substantially C-shaped transverse cross section with a bight portion 90 and first and second annular leg portions 92 and 94 extending radially inwardly from bight portion 90. Bight portion 90 and leg portions 92 and 94 define an annular coupling groove 96 for receiving annular flanges 58 and 80 of weathershed housings 18 and 20, respectively. Preferably, insulating collar 22 is made of a polymeric, elastomeric material, such as alumina trihydrate (ATH) filled ethylene propylene monomers (EPM), ethylene propylene diene monomers (EPDM) and silicone elastomers, or filled epoxy, or filled polyester.

Figure 3:
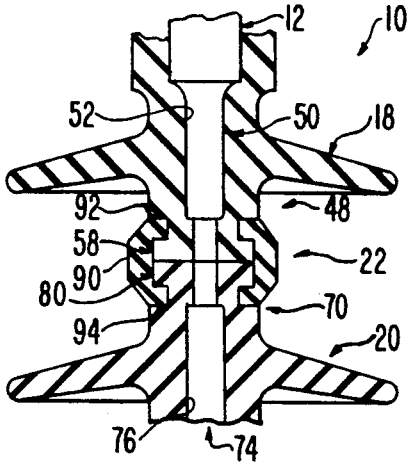
FIG. 3 is an enlarged, partial side elevational view in longitudinal cross section of the electrical assembly illustrated in FIGS. 1 and 2, with a collar coupling two housings together and a core member being partially inserted therein.

Leg portions 92 and 94 have cylindrical inner surfaces 95 and 97, respectively, at their free end, which define the inner-most diameter of insulating collar 22. Preferably, the inner diameter defined by surfaces 95 and 97 of insulating collar 22 is smaller than the outer diameter of cylindrical surfaces 64 and 86 of recesses 56 and 78 of weathershed housings 18 and 20 as seen in FIG. 3. Accordingly, when insulating collar 22 is placed over lower and upper end portions 48 and 70 of weathershed housings 18 and 20, the leg portions 92 and 94 will be located in annular recesses 56 and 78, respectively, for slightly compressing inwardly lower and upper end portions 48 and 70.

Referring again to collar 22 in FIG. 2, annular coupling groove 96 is defined by a pair of opposed annular, axially extending planar coupling walls 102 and 104 and radially inwardly facing cylindrical surface 106 interconnecting opposed coupling walls 102 and 104. Cylindrical surface 106 has an inner diameter that is preferably smaller than the outer diameter of flanges 58 and 80 in their unstressed state i.e., prior to insertion of core member 12 into bores 50 and 74 of weathershed housings 18 and 20.

The width of annular coupling groove 96, measured in the axial direction between opposed walls 102 and 104, is preferably the same or slightly smaller than the combined widths, or axial thicknesses, of annular flanges 58 and 80 to provide a slight interference fit therebetween.

As seen in FIG. 1, end collars 24 and 26 are substantially identical, except that they face in opposite directions. Accordingly, only end collar 24 will be discussed in detail.

Referring to FIGS. 1 and 5, end collar 24 has an axially extending bore 111 with a frustoconical inner surface portion 112, a cylindrical inner surface portion 114 and an annular groove 116 located between inner surface portion 112 and inner surface portion 114. End flange 54 of weathershed housing 18 is fitted into annular groove 116 and forced into intimate contact with end collar 24 upon insertion of core member 12 into bore 50 of weathershed housing 18 to provide an effective seal between weathershed housing 18 and end fitting 14. End collar 24 is fixedly coupled to end fitting 14 by pressing end fitting 14 into bore 111, until it firmly engages end collar 24 by a friction fit. In particular, frustoconical portion 112 of end collar 24 firmly engages tapering surface 42 of end fitting 12 to ensure firm electrical contact therebetween.

End collar 26 is similarly coupled to end fitting 16 by a press fit and flange 88 of weathershed housing 20 is received in annular groove 120 of end collar 26 to seal lower end portion 72 of weathershed housing 20. As particularly seen in FIGS. 1 and 5, an optional metallic corona shield **68*a* is rigidly coupled to end collar 24 by rivets 69. Similarly, a corona shield 68*b* is rigidly coupled to end collar 26**.

ASSEMBLY OF ELECTRICAL ASSEMBLY 10 OF FIGS. 1–5

Preferably, electrical assembly 10 is assembled by first stretching or expanding insulating collar 22 over lower end portion 48 of weathershed housing 18 and upper end portion 70 of weathershed housing 20. Then insulating collar 22 is permitted to contract to its original unstressed diameter, and thereby slightly compressing or collapsing lower end portion 48 and upper end portion 70 inwardly as seen in FIG. 3. In particular, an inwardly extending force is applied to the lower and upper end portions 48 and 70 by the insulating collar 22 due to its elasticity. In this position, legs 92 and 94 of collar 22 are received in annular recesses 56 and 78 of weathershed housings 18 and 20, respectively, while annular coupling groove 96 receives flanges 58 and 80 of weathershed housings 18 and 20.

Next, end collars 24 and 26 are coupled to weathershed housings 18 and 20 by squeezing or compressing upper end portion 46 of weathershed housing 18 and lower end portion 72 of weathershed housing 20, and inserting them into bores 111 and 118 of end collars 24 and 26, respectively. Upper end portion 46 then expands radially outwardly into annular groove 116 of end collar 24, while lower end portion 72 expands radially outwardly into annular groove 120.

Figure 4:
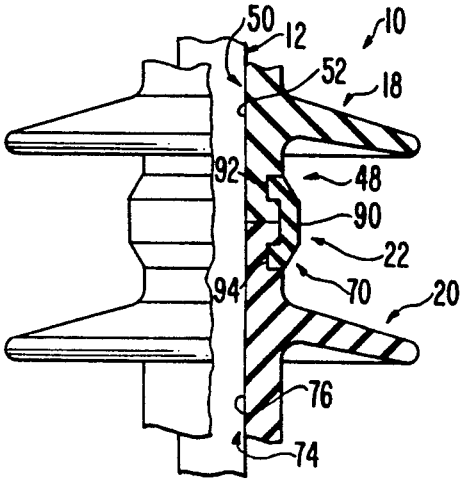
FIG. 4 is an enlarged, partial side elevational view in partial section of the electrical assembly illustrated in FIGS. 1–3, after being completely assembled.

Now, end fitting 16 is crimped or swaged onto core member 12. Core member 12 is then inserted into bores 50 and 74 of weathershed housings 18 and 20 to expand, or dilate, weathershed housings 18 and 20 radially outwardly, thereby providing an interference fit between the entire length of core member 12 and inner surfaces 52 and 76 of weathershed housings 18 and 20. The outward radial expansion of weathershed housings 18 and 20 by core member 12 produces a radially outwardly directed and extending force. This radially directed force causes intimate contact between weathershed housings 18 and 20 and insulating collar 22, and their respective end collars 24 or 26 to provide a weathertight seal therebetween as seen in FIGS. 1 and 4. In applications where electrical assembly 10 is subjected to high pressure washings, insulating collar 22 can also be adhesively bonded to weathershed housings 18 and 20 by sealants or adhesive sealants, such as room temperature-vulcanizing (RTV) silicone or butyl rubber, for additional sealing at the interface of weathershed housings 18 and 20 and collar 22.

Finally, weathershed housings 18 and 20 are axially compressed to allow end fitting 14 to be crimped or swaged onto core member 12 for fixedly coupling end fitting 14 to core member 12. Weathershed housings 18 and 20 are now held under a uniform axial compression by end fittings 14 and 16. The end collars 24 and 26 are driven onto the tapered portions of end fittings 14 and 16, respectively, to complete the assembly.

EMBODIMENT OF FIG. 6

Figure 6:
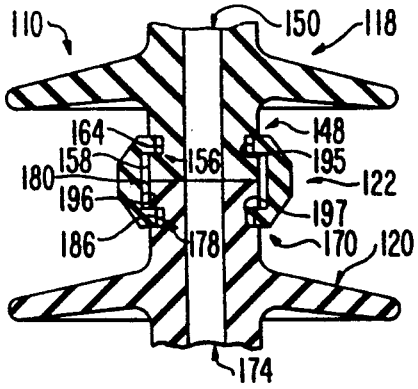
FIG. 6 is a partial side elevational view in longitudinal cross section of a second embodiment of an electrical assembly in accordance with the present invention using a modified collar.

As seen in FIG. 6, and referring to a second embodiment of the invention, in electrical assembly 110 the inner diameter defined by surfaces 195 and 197 of insulating collar 122 can be the same size or even larger than the outer diameters of cylindrical surfaces 164 and 186 of recesses 156 and 178 of weathershed housings 118 and 120. However, this would require greater radial outward expansion of weathershed housings 118 and 120 by the core member to couple and seal insulating collar 122 thereto, than if a smaller diameter insulating collar 22 is used as seen in FIGS. 1-5.

The inner diameter of the groove 196 in insulating collar 122 could be the same size or larger than the outer diameter of annular flanges 158 and 180 of weathershed housings 118 and 120 as seen in FIG. 6. However in that case, the core member must have a considerably larger outer diameter than the inner diameter of the weathershed housings 118 and 120 to dilate or expand the weathershed housings 118 and 120 outwardly into intimate contact with insulating collar 122. The parts 148, 150, 170, 174 of the second embodiment illustrated in FIG. 6 are similar to the parts 48, 50, 70, and 74, respectively, of the embodiment shown in FIGS. 1-5.

EMBODIMENT OF FIG. 7

Figure 7:
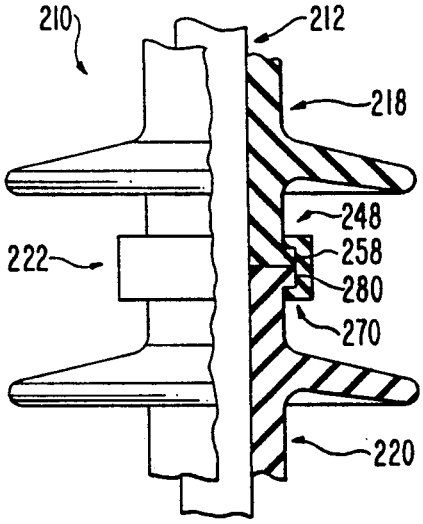
FIG. 7 is a partial side elevational view in partial cross section of a third embodiment of an electrical assembly in accordance with the present invention using a modified collar.

Referring now to FIG. 7, a third electrical assembly 210 of the present invention is illustrated in the form of an insulator using a core member 212. Electrical assembly 210 is substantially identical to electrical assembly 10, and therefore will not be discussed in detail. The only differences between electrical assembly 210 and electrical assembly 10 are that the end portions 248 and 270 of weathershed housings 218 and 220 have been modified to have outwardly extending annular flanges 258 and 280, respectively, and the outer surface of insulating collar 222 has been modified to make it cylindrical.

EMBODIMENT OF FIG. 8

Figure 8:
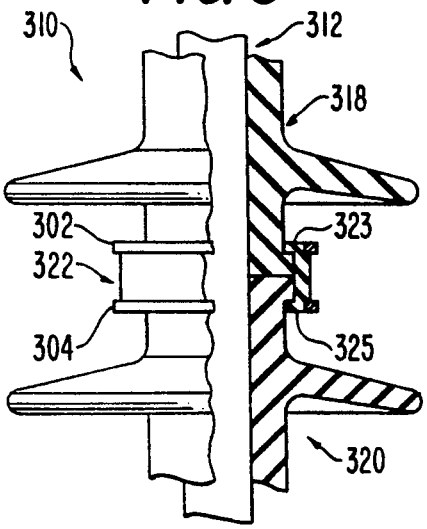
FIG. 8 is a partial side elevational view in partial cross section of a fourth embodiment of an electrical assembly in accordance with the present invention using a further modified collar.

Referring now to FIG. 8, a third electrical assembly 310 in accordance with the present invention is illustrated in the form of an insulator. Electrical assembly 310 is substantially identical to electrical assembly 210, illustrated in FIG. 7, except that insulating collar 322 has been provided with a pair of rigid, metallic backup rings 302 and 304. Accordingly, the electrical assembly 310 will not be discussed in detail herein.

Rings 302 and 304 encircle insulating collar 322 to limit the radial outward expansion or movement of insulating collar 322 by weathershed housings 318 and 320, upon insertion of core member 312 into their axially extending bores. Accordingly, rings 302 and 304 provide additional support for insulating collar 322. As seen in FIG. 8, rings 302 and 304 are parallel to one another and are received, respectively, in annular grooves 323 and 325 formed at opposite axial ends of collar 322. Rings 302 and 304 can also be made of a rigid insulating material, such as epoxy or polyester.

EMBODIMENT OF FIGS. 9 AND 10

Figure 9:
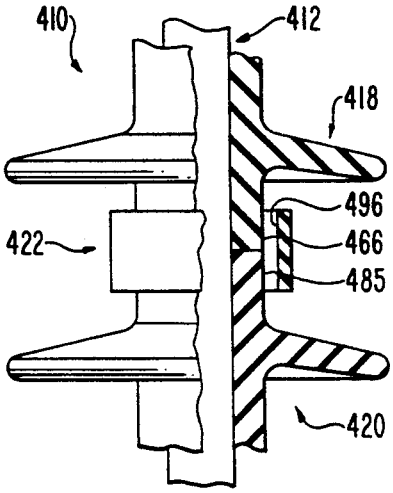
FIG. 9 is a partial side elevational view in partial cross section of a fifth embodiment of an electrical assembly utilizing a heat shrinkable insulating collar, shown prior to being heated and shrunk in accordance with the present invention.
Figure 10:
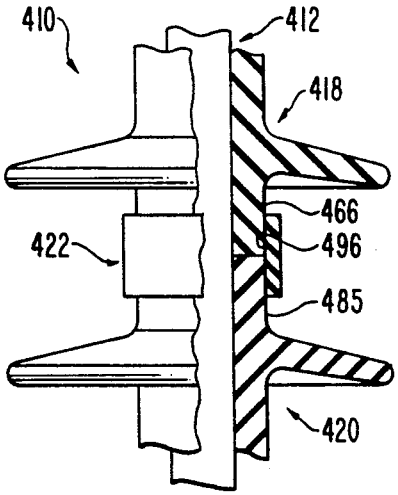
FIG. 10 is a partial side elevational view in partial cross section of the electrical assembly shown in FIG. 9 with the heat shrinkable insulating collar radially shrunk about the end portions of the weathershed housings.

Turning to FIGS. 9 and 10, a fourth electrical assembly 410 in accordance with the present invention is illustrated in the form of an insulator using a preferably rigid core member 412. Since electrical assembly 410 is substantially identical to electrical assembly 10, except for the manner in which adjacent ends of weathershed housings 418 and 420 are coupled together, it will not be discussed in detail. Basically, insulating collar 22 of electrical assembly 10 has been replaced with a heat shrinkable collar 422 and annular recesses 56 and 78 have been deleted to create a smooth outer surface.

Heat shrinkable collar 422 is composed of any suitable polymeric material which is capable of being heat shrinkable and is elastic after being shrunk. Examples are polyolefins and olefin copolymers. Examples of suitable heat shrinkable tubes are disclosed in U.S. Pat. No. 4,207,364 to Nyberg and U.S. Pat. No. 4,390,745 to Bottcher et al, the subject matter of which are both hereby incorporated herein by reference.

Collar 422, in its expanded state, has a larger inner diameter 496 than the outer diameters 466 and 485 of the end portions of weathershed housings 418 and 420. Accordingly, collar 422, in its expanded state, is placed about the lower and upper end portions of weathershed housings 418 and 420, and then heated to cause collar 422 to shrink radially inwardly about the end portions of weathershed housings 418 and 420. In other words, when heat is applied to collar 422, the collar 422 shrinks to an inner diameter, which is smaller than the outer diameters 466 and 485 of the end portions of weathershed housings 418 and 420 in their unstressed state. Thus, collar 422 applies a radially inwardly directed or extending force to the end portions of weathershed housings 418 and 420 to compress weathershed housings 418 and 420 inwardly for ensuring a weathertight seal therebetween.

EMBODIMENT OF FIG. 11

Figure 11:
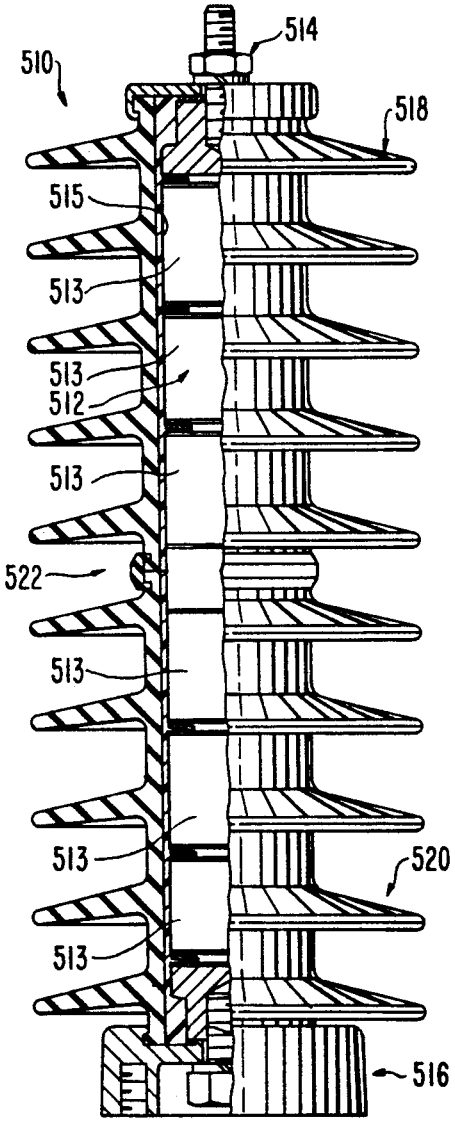
FIG. 11 is a partial side elevational view in partial cross section of a sixth embodiment of an electrical assembly in the form of a surge arrester, in accordance with the present invention.

Referring now to FIG. 11, an electrical assembly 510 in accordance with the present invention is illustrated in the form of a surge arrester. Electrical assembly 510 has a pair of weathershed housings 518 and 520 coupled together by an insulating collar 522, which are substantially identical to weathershed housings 18 and 20 and insulating collar 22 of electrical assembly 10. Accordingly, the construction and assembly of weathershed housings 518 and 520 and insulating collar 522 will not be discussed in detail herein.

Core member 512 of this embodiment utilizes a plurality of metal oxide varistor blocks 513 which are encased in fiberglass 515, and which are electrically connected together and to end fittings 514 and 516.

Core member 512 and end fittings 514 and 516 are discussed in detail in U.S. Pat. No. 4,899,248 to Raudabaugh and U.S. Pat. No. 4,905,118 to Sakich, the subject matter of which are both hereby incorporated herein by reference.

Insertion of core member 512 into the weathershed housings 518 and 520 forces the housings radially outwardly to provide a weathertight seal between the housings as discussed above regarding the embodiments of FIGS. 1-5, 6, 7 and 8. Collar 422 of the embodiment of FIGS. 9-10 could also be used in the FIG. 11 embodiment.

While several embodiments have been chosen to illustrate the invention, it will be understood by those skilled in the art that various changes and modifications can be made herein without departing from the scope of the invention as defined in the appended claims.

What is claimed is:

1. An electrical assembly, the combination comprising:

a core member having an outer surface with a predetermined cross-sectional width;

first and second weathershed housings formed of an elastomeric material, each of said weathershed housings having a first end, a second end, and an axially extending bore with a predetermined cross-sectional width for slideably receiving said core member therein, said second end of said first weathershed housing having a portion with a predetermined outer diameter, and said first end of said second weathershed housing having a portion with a predetermined outer diameter; and means for coupling and sealing said first and second weathershed housings together, said means for coupling and sealing including an insulating collar having an axially extending bore with a predetermined inner diameter for receiving said portions of said first and second weathershed housings, said inner diameter of said insulating collar, said outer diameters of said portions of said first and second weathershed housings, said cross-sectional widths of said bores of said weathershed housings, and said cross-sectional width of said core member being constructed and sized to apply a radially directed compressive force on said portions of said weathershed housings causing relative radial movement of said insulating collar and said portions of said first and second weathershed housings, and causing intimate contact between said insulating collar and said first and second weathershed housings without having to apply an axially directed compressive force on said first end said first weathershed housing and said second end of said second weathershed housing to seal said weathershed housings together.

2. An electrical assembly according to claim 1, wherein said core member is an elongated insulating rod.

3. An electrical assembly according to claim 1, wherein said core member includes a plurality of electrical components.

4. An electrical assembly according to claim 3, wherein said electrical components include a plurality of metal oxide varistor blocks.

5. An electrical assembly according to claim 1, wherein each of said portions of said first and second weathershed housings includes an outwardly extending annular flange, and said insulating collar includes an annular groove for receiving said flanges therein.

6. An electrical assembly according to claim 5, wherein said cross-sectional widths of said bores of said first and second weathershed housings are smaller than said cross-sectional width of said core member for causing radial outward expansion of said first and second weathershed housings into intimate contact with said insulating collar upon insertion of said core member into said bores of said first and second weathershed housings.

7. An electrical assembly according to claim 6, wherein said bores of said first and second weathershed housings are substantially cylindrical, and said outer surface of said core member is substantially cylindrical.

8. An electrical assembly according to claim 5, wherein said insulating collar is formed of an elastomeric material.

9. An electrical assembly according to claim 8, wherein said inner diameter of said bore of said insulating collar is smaller than said outer diameters of said portions of said first and second weathershed housings for compressing said portions of said first and second weathershed housings radially inwardly and for reducing said cross-sectional widths of said bores of said first and second weathershed housings adjacent said portions to a smaller cross-sectional width than said cross-sectional width of said core member upon applying said insulating collar over said portions.

10. An electrical assembly according to claim 9, wherein said cross-sectional widths of said bores of said first and second weathershed housings are smaller than said cross-sectional width of said core member prior to applying said insulating collar over said portions of said first and second weathershed housings.

11. An electrical assembly according to claim 5, wherein said inner diameter of said bore of said insulating collar is larger than said outer diameters of said portions of said first and second weathershed housings

12. An electrical assembly, the combination comprising:

a core member having an outer surface with a predetermined cross-sectional width;

first and second weathershed housings formed of an elastomeric material, each of said weathershed housings having a first end, a second end, and an axially extending bore with a predetermined cross-sectional width for slideably receiving said core member therein, said second end of said first weathershed housing having a portion with a predetermined outer diameter, and said first end of said second weathershed housing having a portion with a predetermined outer diameter; and means for coupling and sealing said first and second weathershed housings together, said means for coupling and sealing including an insulating collar having an axially extending bore with an inner diameter for receiving said portions of said first and second weathershed housings, said inner diameter of said insulating collar and said outer diameters of said portions of said first and second weathershed housings being sized to intimately contact one another upon applying a radially directed force causing relative radial movement and said insulating collar and said portions of said first and second weathershed housings, said insulating collar having at least one rigid ring coupled thereto for supporting and limiting radial outward expansion of said insulating collar.

13. An electrical assembly according to claim 12, wherein said rigid ring is metallic.

14. An electrical assembly according to claim 12, wherein said insulating collar has a pair of said rigid rings.

15. An electrical assembly according to claim 1, wherein said insulating collar is a heat shrinkable collar having an inner diameter that is larger than said outer diameters of said portions of said first and second weathershed housings prior to applying heat to said insulating collar, and having said inner diameter smaller than said outer diameters of said portions of said first and second weathershed housings after applying heat to said insulating collar for shrinking said insulating collar to intimately contact and to compress inwardly said portions of said first and second weathershed housings.

16. A method of coupling together sections of weathershed housings of an electrical assembly, comprising the steps of placing an insulating collar having an axially extending bore with an inner diameter over adjacent end portions of first and second weathershed housings formed of an elastomeric material, each of the weathershed housings having an axially extending bore with a predetermined cross-sectional width, and each of the adjacent end portions having an outer diameter with a predetermined cross-sectional width, and inserting a core member having an outer surface with a predetermined cross-sectional width into the bores of the weathershed housings for contacting and expanding the adjacent end portions of the weathershed housings radially outwardly into intimate contact with the insulating collar, thereby coupling and sealing the adjacent ends of the weathershed housings together.

17. A method according to claim 16, wherein the insulating collar is formed of an elastomeric material.

18. A method according to claim 16, wherein the inner diameter of the bore of the insulating collar is smaller than the outer diameters of the adjacent end portions of the weathershed housings, and the placing step comprises compressing the adjacent end portions of the weathershed housing radially inwardly and reducing the cross-sectional widths of the bores of the weathershed housings adjacent the adjacent end portions to a smaller cross-sectional width than the cross-sectional width of the core member upon applying the insulating collar over the adjacent end portions.

19. A method according to claim 18, wherein providing the cross-sectional widths of the bores of the weathershed housings with smaller cross-sectional widths than the cross-sectional width of the core member prior to applying the insulating collar over the adjacent end portions of the first and second weathershed housings.

20. A method according to claim 18, wherein providing the cross-sectional widths of the bores of the weathershed housings with cross-sectional widths substantially equal to the cross-sectional width of the core member prior to applying the insulating collar over the adjacent end portions of the weathershed housings.

21. A method according to claim 16, wherein the inserting step comprises providing the inner diameter of the bore of the insulating collar with an inner diameter larger than the outer diameters of the adjacent end portions of the weathershed housings, and the cross-sectional widths of the weathershed housings smaller than the cross-sectional width of the core member for expanding radially outwardly into intimate contact with the insulating collar upon inserting the core member into the bores of the weathershed housings.

22. An electrical assembly, the combination comprising:

a core member having an outer surface with a predetermined cross-sectional width;

first and second weathershed housings formed of an elastomeric material, each of said weathershed housings having a first end, a second end, and an axially extending bore with a predetermined cross-sectional width for slideably receiving said core member therein, said second end of said first weathershed housing having a portion with a predetermined outer diameter, and said first end of said second weathershed housing having a portion with a predetermined outer diameter; and means for coupling and sealing said first and second weathershed housings together, said means for coupling and sealing including an insulating collar having an axially extending bore with an inner diameter for receiving said portions of said first and second weathershed housings, said inner diameter of said insulating collar being smaller than said outer diameters of said portions of said first and second weathershed housings prior to insertion of said core member into said bores of said weathershed housings, and said predetermined cross-sectional width of said core member being larger than said predetermined cross-sectional widths of said bores of said weathershed housings to expand said portions of said first and second weathershed housings causing intimate contact between said insulating collar and said portions of said first and second weathershed housings.

* * * * *